United States Patent [19]

Bradley

[11] Patent Number: 4,611,264

[45] Date of Patent: Sep. 9, 1986

[54] COMBINATION SWITCH LIGHT AND RECHARGEABLE FLASHLIGHT

[76] Inventor: Morgan B. Bradley, 15725 Spanaway Loop Rd., Spanaway, Wash. 98387

[21] Appl. No.: 491,398

[22] Filed: May 4, 1983

[51] Int. Cl.[4] ..... F21V 33/00; F21L 7/00

[52] U.S. Cl. ..... 362/95; 362/183; 362/191; 362/200

[58] Field of Search ..... 362/95, 190, 191, 183, 362/200

[56] References Cited

U.S. PATENT DOCUMENTS

| | | | |
|---|---|---|---|
| 2,580,056 | 12/1951 | Wheeler, Jr. | 362/95 |
| 3,192,378 | 6/1965 | Oldenburger | 362/183 |
| 3,233,091 | 2/1966 | Hunt | 362/183 |
| 3,250,911 | 5/1966 | Oldenburger | 362/183 |
| 4,052,610 | 10/1977 | Sternlicht | 362/200 |
| 4,204,272 | 5/1980 | Kim | 362/200 |
| 4,425,600 | 1/1984 | Barnhart | 362/200 |

FOREIGN PATENT DOCUMENTS

| | | | |
|---|---|---|---|
| 2410214 | 7/1979 | France | 362/183 |

*Primary Examiner*—Ira S. Lazarus

[57] ABSTRACT

This combination device serves to indicate to the users where a wall switch is located in a room, by having a small light, which stays lighted until its battery needs recharging. The device also serves as a removable flashlight for emergency or other use, and the device is secured to a mounting plate that is secured to the face of the wall switch plate, and it is quickly and easily removed from its mounting plate, when desired.

1 Claim, 4 Drawing Figures

FIG. 1
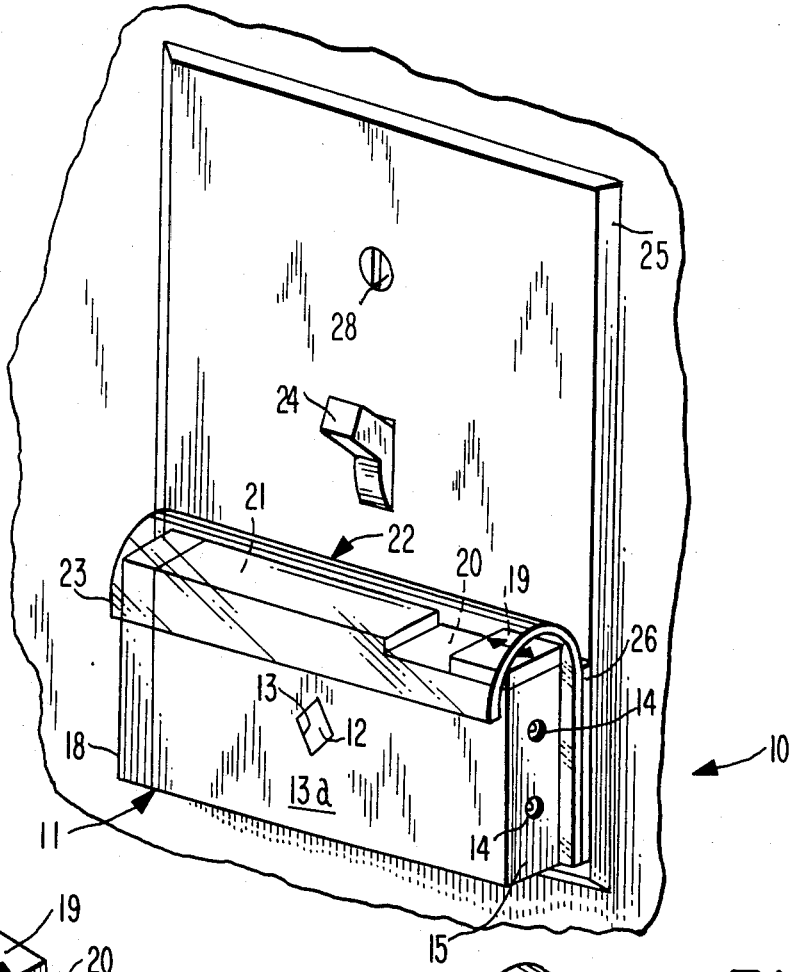
FIG. 2
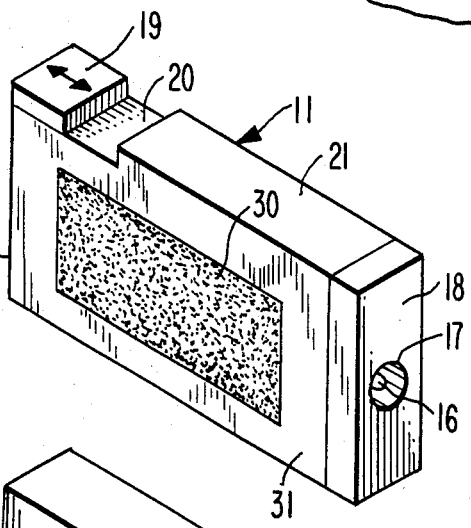
FIG. 3
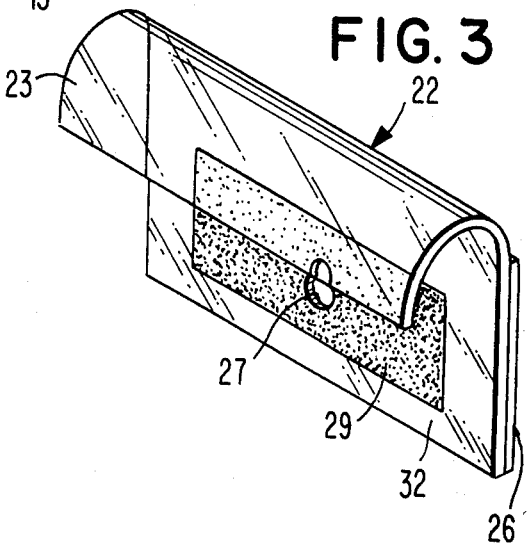
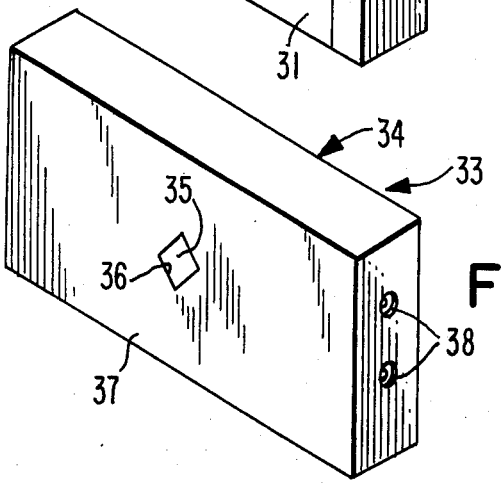
FIG. 4

COMBINATION SWITCH LIGHT AND RECHARGEABLE FLASHLIGHT

This invention relates to wall switches, and more particularly, to a combination switch light and rechargeable flashlight.

The principal object of this invention is to provide a combination switch light and rechargeable flashlight, which will indicate where the light switch is located in a room.

Another object of this invention is to provide a combination switch light and rechargeable flashlight, which will be placed on a light switch, and will have a small light therein, so as to indicate the location of the light switch, particularly in the dark.

Another object of this invention is to provide a combination switch light and rechargeable flashlight, which will be a reliable and quickly locatable flashlight, with or without its fastener or mounting device, and it may be placed anywhere, such as in automotive vehicles, purses, entryways, boats, etc. However, its intended objectives are most advantageous when it is located on the light switch.

A further object of this invention is to provide a combination switch light and rechargeable flashlight, which will be designed to help people, especially in emergencies, to locate the light switch in a room, by seeing the small light therein, which will remain on at all times, and in situations where the power goes out, the flashlight will be readily available, even in the daytime.

A still further object of this invention is to provide a combination switch light and rechargeable flashlight, which will be further unique, in that, with its rechargeable feature, it will indicate clearly when it needs to be recharged, and this eliminates any risk as to the unit's reliability, and prevents any unnecessary charging, or replacement. The abovementioned is accomplished by printed instructions informing the user to place the unit in a patented charging device, if its small indicator light is off, and when the indicator light comes on, the unit is then mounted again on the wall switch plate.

An even further object of this invention is to provide a switch light and rechargeable flashlight, which will save time and frustration, as associated with the lack of light, and it may be instrumental, even, in saving lives.

Other objects are to provide a combination switch light and rechargeable flashlight, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, shown mounted to a wall switch plate;

FIG. 2 is a rear perspective view of the invention, shown removed from its mounting plate;

FIG. 3 is a perspective view of the mounting plate, shown removed from the wall switch plate, and FIG. 4 is a perspective view of a modified form of the invention.

According to this invention, a flashlight 10 is shown to consist of a rectangularly configurated housing 11, having a bulb (not shown) which is secured behind lens 12, that is fixedly secured within diamond-shaped opening 13 of the front wall 13*a*. A pair of female jacks 14 are secured in one end wall 15 of housing 11 in a suitable manner, so as to recharge the battery on the interior thereof, by a standard battery charger. A bulb 16, wired into the circuit of the battery of flashlight 10, is visible from within opening 17 of the opposite end wall 18, and a slide-type switch 19 is mounted into a recessed shoulder 20 in the top wall 21 of flashlight 10, so as to switch it on and off when it is removed from the mounting plate 22, which is fabricated of a clear plastic material. The top portion 23 of mounting plate 22 is arcuately curved forward, so as to form an overhang, to cover the top of flashlight 10, and prevent accidental or partial removal of flashlight 10, when tampered with by small children, or during light switching by the users, etc. Plate 22 is mounted to the face of the wall switch plate 25, by an adhesive strip 26, (not shown) which is secured to the face of switch plate 25 by a similar adhesive. An opening 27, through mounting plate 22 and its adhesive strip, enables access to the bottom screw fastener 28 of switch plate 25, when it is desirable to remove plate 25, and it is to be noted, that the adhesive strip on the rear of mounting plate 22 serves to enable flashlight 10 to be mounted anywhere the user desires.

A pair of velcro-type fastener strips 29 and 30 are, one each, fixedly secured, at their rear sides, to rear face 31 of flashlight 10, and the front face 32 of mounting plate 22, so as to render them secure to each other by their loops and hooks, until it is desired to use or recharge flashlight 10.

In use, the bulb behind the lens 12, within opening 13, remains lighted when flashlight 10 is secured to the mounting plate 22, and when it fails to light, the flashlight 10 is pulled away from engagement with the velcro strip 29 of mounting plate 22, and recharged with a charging unit, by employing the female jacks 14 thereof. When flashlight 10 is to be used for a flashlight only, it is similarly removed as described, and the slide switch 19 is used to turn the bulb 16 on and off, and it is to be further noted, that light will be emitted from the lens 12 at all times when the battery contains a charge.

Referring now to FIG. 4 of the drawing, a modified unit 33 includes a housing 34, having a similar rechargeable battery on its interior, as was heretofore described of housing 11. However, a bulb (not shown), and behind lens 35 of opening 36, in front wall 37, serves to locate a wall switch 24 in a room, and housing 34 also includes jacks 38 for recharging of its battery.

In use, unit 33 is similarly mounted as was heretofore described of flashlight 10, with the exception, that unit 33 is employed only for locating the wall switch 24.

While various changes may be made in the detail construction, it is understood that such changes will be within the spirit and scope of the present invention, as is defined by the appended claims.

What I now claim is:

1. A combination switch light and rechargeable flashlight, comprising a rectangular housing, a battery and an electric lamp bulb inside said housing, a lamp light opening in one end wall of said housing, a pair of female jacks on an opposite end wall of said housing in electrical circuit with said battery and said bulb, a slide switch in a recess on a top wall of said housing being in said circuit, a mounting plate adjacent a rear side of said housing having a rolled over upper end enclosing said slide switch, a velcro loop pile fastener pad on a rear side of said housing and a velcro loop pile fastener pad on the front side of said mounting plate for selective detachable attachment of said housing on said mounting plate, and a wall switch plate fixedly secured by adhesive means to a rear side of said mounting plate; and a small night light second lamp bulb also inside said housing and in circuit with said battery, said second lamp bulb being behind a lens in a diamond-shaped opening on a front side of said housing, said front side being a longitudinal side of said flashlight.

* * * * *